US007911407B1

(12) United States Patent
Fong et al.

(10) Patent No.: US 7,911,407 B1
(45) Date of Patent: Mar. 22, 2011

(54) METHOD FOR DESIGNING ARTIFICIAL SURFACE IMPEDANCE STRUCTURES CHARACTERIZED BY AN IMPEDANCE TENSOR WITH COMPLEX COMPONENTS

(75) Inventors: Bryan Ho Lim Fong, Los Angeles, CA (US); Joseph S. Colburn, Malibu, CA (US); Paul R. Herz, Santa Monica, CA (US); John J. Ottusch, Malibu, CA (US); Daniel F. Sievenpiper, Santa Monica, CA (US); John L. Visher, Malibu, CA (US)

(73) Assignee: HRL Laboratories, LLC, Malibu, CA (US)

( * ) Notice: Subject to any disclaimer, the term of this patent is extended or adjusted under 35 U.S.C. 154(b) by 355 days.

(21) Appl. No.: 12/138,083

(22) Filed: Jun. 12, 2008

(51) Int. Cl.
*H01Q 15/02* (2006.01)
*H01Q 1/38* (2006.01)

(52) U.S. Cl. ..... 343/909; 343/700 MS; 343/754

(58) Field of Classification Search ..... 343/909, 343/700 MS, 753, 754, 756
See application file for complete search history.

(56) References Cited

U.S. PATENT DOCUMENTS

| | | | | |
|---|---|---|---|---|
| 5,486,837 | A | 1/1996 | Miller | |
| 5,917,458 | A | 6/1999 | Ho et al. | |
| 6,208,316 | B1 | 3/2001 | Cahill | |
| 6,262,495 | B1 | 7/2001 | Yablonovitch et al. | |
| 6,323,826 | B1 | 11/2001 | Sievenpiper et al. | 343/909 |
| 6,483,480 | B1 | 11/2002 | Sievenpiper et al. | 343/909 |
| 6,483,481 | B1 | 11/2002 | Sievenpiper et al. | |
| 6,496,155 | B1 | 12/2002 | Sievenpiper et al. | 343/770 |
| 6,512,494 | B1 | 1/2003 | Diaz et al. | |
| 6,518,931 | B1 | 2/2003 | Sievepiper et al. | |
| 6,538,621 | B1 | 3/2003 | Sievenpiper et al. | 343/909 |
| 6,552,696 | B1 | 4/2003 | Sievenpiper | |

(Continued)

FOREIGN PATENT DOCUMENTS

EP 1 508 940 A1 2/2005

(Continued)

OTHER PUBLICATIONS

Checcacci, V., et al., "Holographic Antennas", *IEEE Transactions on Antennas and Propagation*, vol. 18, No. 6, pp. 811-813, Nov. 1970.

(Continued)

*Primary Examiner* — Hoang V Nguyen
(74) *Attorney, Agent, or Firm* — Ladas & Parry

(57) ABSTRACT

A method for designing artificial impedance surfaces is disclosed. The method involves matching impedance component values required for a given far-field radiation pattern (determined, for example, by holographic means) with measured or simulated impedance component values for the units of a lattice of conductive structures used to create an artificial impedance surface, where the units of the lattice have varied geometry. For example, a unit could be a square conductive structure with a slice (removed or missing material) through it. The measured or simulated impedance components are determined by measuring wavevector values for test surfaces in three or more directions over any number of test surfaces, where each unit of a given test surface has the same geometric shape and proportions as all of the other units of that test surface, but each test surface has some form of variation in the unit geometry from the other test surfaces. These test measurements create a table of geometry vs. impedance components that are used to design the artificial impedance structure. Since polarization can be controlled, the structure can be an artificial impedance surface characterized by a tensor impedance having complex components.

15 Claims, 7 Drawing Sheets

U.S. PATENT DOCUMENTS

| | | | | |
|---|---|---|---|---|
| 6,690,327 | B2 | 2/2004 | McKinzie et al. | 343/700 MS |
| 6,739,028 | B2 | 5/2004 | Sievenpiper et al. | 29/25.42 |
| 6,774,866 | B2 * | 8/2004 | McKinzie et al. | 343/909 |
| 6,806,846 | B1 | 10/2004 | West | |
| 6,897,831 | B2 * | 5/2005 | McKinzie et al. | 343/909 |
| 7,136,029 | B2 | 11/2006 | Ramprasard et al. | |
| 7,197,800 | B2 | 4/2007 | Sievenpiper et al. | 29/25.42 |
| 7,218,281 | B2 | 5/2007 | Sievenpiper et al. | 343/700 MS |
| 7,245,269 | B2 | 7/2007 | Sievenpiper et al. | 343/909 |
| 7,411,565 | B2 * | 8/2008 | McKinzie et al. | 343/909 |
| 7,420,524 | B2 * | 9/2008 | Werner et al. | 343/909 |
| 7,471,247 | B2 * | 12/2008 | Saily et al. | 343/700 MS |
| 2003/0112186 | A1 | 6/2003 | Sanchez et al. | |
| 2005/0029632 | A1 | 2/2005 | McKinzie et al. | |
| 2006/0050010 | A1 | 3/2006 | Choi et al. | |
| 2006/0152430 | A1 | 7/2006 | Seddon et al. | |

FOREIGN PATENT DOCUMENTS

| | | | |
|---|---|---|---|
| JP | 2002299951 | A | 10/2002 |
| WO | 2004/093244 | A2 | 10/2004 |

OTHER PUBLICATIONS

Fathy, A.E., et al., "Silicon-Based Reconfigurable Antennas—Concepts, Analysis, Implementation and Feasibility", *IEEE Transactions on Microwave Theory and Techniques*, vol. 51, No. 6, pp. 1650-1661, Jun. 2003.

King, R., et al., "The Synthesis of Surface Reactance Using an Artificial Dielectric", *IEEE Transactions on Antennas and Propagation*, vol. 31, No. 3, pp. 471-476, May 1993.

Levis, K., et al., "Ka-Band Dipole Holographic Antennas", *IEEE Proceedings of Microwaves, Antennas and Propagation*, vol. 148, No. 2, pp. 129-132, Apr. 2001.

Mitra, R., et al., Techniques for Analyzing Frequency Selective Surfaces—A Review, *Proceedings of the IEEE*, vol. 76, No. 12, pp. 1593-1615, Dec. 1988.

Oliner, A., et al., "Guided waves on sinusoidally-modulated reactance surfaces", *IEEE Transactions on Antennas and Propagation*, vol. 7, No. 5, pp. 201-208, Dec. 1959.

Pease, R., "Radiation from Modulated Surface Wave Structures II" *IRE International Convention Record*, vol. 5, pp. 161-165, Mar. 1957.

Sazonov, D.M., "Computer Aided Design of Holographic Antennas and Propagation", *IEEE International Symposium of the Antennas and the Propagation Society 1999*, vol. 2, pp. 738-741, Jul. 1999.

Sievenpiper, D., et al., "High-Impedance Electromagnetic Surfaces with a Forbidden Frequency Band", *IEEE Transactions on Microwave Theory and Techniques*, vol. 47, No. 11, pp. 2059-2074, Nov. 1999.

Thomas, A., et al., "Radiation from Modulated Surface Wave Structures I", *IRE International Convention Record*, vol. 5, pp. 153-160, Mar. 1957.

* cited by examiner

METHOD FOR DESIGNING ARTIFICIAL SURFACE IMPEDANCE STRUCTURES CHARACTERIZED BY AN IMPEDANCE TENSOR WITH COMPLEX COMPONENTS

CROSS REFERENCE TO RELATED APPLICATIONS

This application is related to U.S. application Ser. No. 11/173,182 "Artificial Impedance Structure" by Daniel Sievenpiper et al, filed Jul. 1, 2005, which is incorporated herein by reference in its entirety. This application is also related to U.S. Pat. No. 7,218,281 to Daniel Sievenpiper et al. "Artificial Impedance Structure" filed Jul. 1, 2005, which is incorporated herein by reference in its entirety.

FIELD

The present disclosure related to the designing of conformal antennas. More particularly, the present invention relates to determining the impedance of artificial impedance structures used with conformal antennas.

BACKGROUND

U.S. Pat. No. 7,218,281 to Daniel Sievenpiper et al. "Artificial Impedance Structure" filed Jul. 1, 2005, discloses how to create a scalar impedance function using a holographic principle. However, artificial impedance surfaces characterized by a scalar impedance lack polarization control.

The method of constructing an artificial impedance surface characterized by a scalar impedance for the controlled scattering of a surface wave (with no polarization control) is disclosed in U.S. application Ser. No. 11/173,182 "Artificial Impedance Structure" by Daniel Sievenpiper et al, filed Jul. 1, 2005. An artificial impedance surface with an impedance modulation created from the interference of surface wave and outgoing wave is constructed from metal patterning on a dielectric substrate.

The prior art for artificial impedance surfaces used only scalar impedances with no polarization control. With a impedance surface characterized by a scalar impedance, only a single mode of the impedance surface is controlled at once, with no regard for the cross-polarization generated by the impedance surface.

SUMMARY

This invention describes how artificial impedance surfaces characterized by an impedance tensor with complex components can be designed and constructed to create far field radiation patterns with desired spatial and polarization properties.

By specifying the tensor impedance properties of the surface, both polarizations may be controlled by the artificial impedance surface, resulting in far field radiation patterns that have not only the desired spatial properties, but also the desired polarization properties.

An artificial impedance surface can be created by metal patterning on a dielectric surface above a ground plane. By varying the local size and spacing of the metal patterning, specific reactive impedance values can be obtained. To scatter a given excitation from the artificial impedance surface into a desired far field pattern, one can use a holographic technique to determine the required space-dependent impedance function, and in turn the local metal patterning necessary to create the desired impedance function. The details of the metal patterning and basic holographic technique are described fully in U.S. application Ser. No. 11/173,182 to D. Sievenpiper, et al.

An optical hologram is created by the interference of an object and reference wave. In the case of an artificial impedance surface characterized by a scalar impedance, the basic holographic technique discussed in U.S. application Ser. No. 11/173,182 takes the object wave to be the surface wave generated by the feed excitation and the reference wave to be the outgoing wave that generates the desired far field radiation pattern. For example, for a surface wave $\psi_{surf}(x)$ generated by a point source on an impedance surface in the x-y plane and a desired outgoing plane wave $\psi_{out}(x)$ with wavenumber k, the interference pattern is given by:

$$\psi_{int}(x)=Re[\psi_{out}\psi_{surf}^{*}]=Re[\exp(ik\cdot x)\exp(-i\kappa\sqrt{(x-x_s)^2+(y-y_s)^2})],$$

where x is the position on the surface, $x_s$ is the point source position, and $\kappa=k\sqrt{1+X^2}$ is the bound surface wave wavevector, and X is the normalized surface impedance. Several points are of note here: the interference is determined by scalar waves; the surface wave is assumed to be generated by a point source on the surface; the surface wave wavevector is fixed and depends on a single impedance value X; the interference varies between −1 and +1. To guide a TM surface wave, the actual impedance function on the surface is given by:

$$Z(x)=-i[X+M\psi_{int}(x)],$$

where M is the size of the impedance modulation, and we have used the time harmonic convention of exp(−iωt). The impedance function varies between −i(X−M) and −i(X+M); these minimum and maximum impedance values are constrained by what is physically realizable using the metal patterning technique mentioned above.

The scalar wave interference hologram described above contains no polarization information and so is unable to control the polarization of the radiation pattern. The scalar impedance boundary condition used to control the TM mode propagation and radiation is given by:

$$E_{tan}(x)=Z(x)\hat{n}\times H_{tan}(x),$$

where x is the coordinate on the impedance boundary surface, $E_{tan}$ is the electric field tangential to the impedance surface, $H_{tan}$ is the magnetic field tangential to the impedance surface, and n is the unit normal of the impedance surface. To control the polarization of the far field one must enforce a tensor impedance boundary condition on the impedance surface:

$$E_{tan}(x)=Z(x)\cdot(\hat{n}\times H_{tan}(x)),$$

where the impedance tensor has four components for the two directions tangential to the impedance surface:

$$Z(x)=\begin{pmatrix} Z_{11}(x) & Z_{12}(x) \\ Z_{12}(x) & Z_{22}(x) \end{pmatrix}.$$

In the scalar impedance case, the basic, lowest order propagating mode is a bound TM mode, whose properties are controlled by the average impedance −iX. The assumed form for the scalar surface wave $\psi_{surf}(x)$ is determined by the details of the feed excitation and the average impedance only. (Note that impedance surfaces characterized by a scalar impedance using a bound TE mode may also be constructed, in a manner analogous to the TM scalar interference hologram, with only a change in sign of the impedance and a change in surface wave wavenumber dependence on the average impedance.) For the tensor impedance case, one may again take the basic, lowest order propagating mode to be a bound TM mode, but instead of interfering two scalar waves for the holographic impedance pattern, one takes an appropriately symmetrized outer product of the surface current and desired outgoing electric field vectors to form the impedance tensor modulation matrix:

$$Z(x) = -i\begin{pmatrix} X & 0 \\ 0 & X \end{pmatrix} - i\frac{M}{2}\mathrm{Im}\left(E_{out}(x) \otimes J^{\dagger}_{surf}(x) - J_{surf}(x) \otimes E^{\dagger}_{out}(x)\right).$$

Here, $E_{out}$ is the electric field of the desired outgoing wave and $J_{surf}$ is the surface current created by the feed. The symmetrization, which creates an anti-Hermitian tensor impedance modulation, ensures that no power is lost or gained through the impedance boundary, and taking imaginary parts ensures reciprocity. For this tensor impedance construction then, the basic TM mode supported by the diagonal X matrix is scattered into the two polarizations with appropriate magnitude and phase by the holographic tensor modulation term. The size of the holographic tensor modulation term is controlled by M, which in turn is determined by what is physically realizable. Note that one may also construct holograms with different current normalizations, i.e., $$Z(x) = -i\begin{pmatrix} X & 0 \\ 0 & X \end{pmatrix} - i\frac{M}{2}\mathrm{Im}\left(E_{out}(x) \otimes \frac{J^{\dagger}_{surf}(x)}{|J_{surf}(x)|^{l}} - \frac{J_{surf}(x)}{|J_{surf}(x)|^{l}} \otimes E^{\dagger}_{out}(x)\right);$$

from numerical tests, it appears that the exponent l=1 results in radiation patterns closest to the desired far field. One may alternatively scatter a basic TE mode into the two polarizations with the following tensor impedance construction:

$$Z(x) = -i\begin{pmatrix} Y & 0 \\ 0 & Y \end{pmatrix} + i\frac{M}{2}\mathrm{Im}\left(E_{out}(x) \otimes J^{\dagger}_{surf}(x) - J_{surf}(x) \otimes E^{\dagger}_{out}(x)\right).$$

The same modulation tensor construction may also be used for a basic surface supporting both TE and TM modes simultaneously at the same frequency.

This invention shows how the tensor impedance function may be implemented using nearly periodic structures with slow variations, and how the surface impedance of periodic structures can be characterized using analytical and computational methods.

This disclosure shows how to implement a impedance surface that can control the polarization of radiation from an artificial impedance surface. Previous artificial impedance surfaces used only scalar impedance, i.e., had no direct control over electromagnetic wave polarization. A surface characterized by tensor impedance with complex components can use a single surface to scatter an excitation into both polarizations, and can create controlled cross-polarization from a linearly polarized feed, as well as circular polarization from a linearly polarized feed. The artificial impedance surface characterized by an impedance tensor can also be used in a reciprocal manner as a receiver. The invention can be used to create a conformal antenna capable of generating and receiving circularly polarized radiation.

Polarization control, and in particular, circular polarization, is necessary for GPS use. Conformal GPS antennas using artificial impedance surfaces as characterized by an impedance tensor with complex components can be incorporated into vehicle designs. Artificial impedance surfaces as characterized by an impedance tensor with complex components can also be used to control scattering.

This disclosure is a natural extension of the scalar holographic impedance surfaces, though it was not obvious how to specify the tensor impedance functions necessary to scatter a given excitation into the desired far field radiation pattern, nor was it obvious how to construct and characterize the unit cell geometries necessary to create the desired tensor impedance functions.

This disclosure describes a method for the characterization of artificial impedance surfaces as characterized by an impedance tensor with complex components, i.e., a method to determine the impedance tensor components by either computational simulation or direct measurement. The embodiment of an artificial impedance surface as characterized by an impedance tensor with complex components uses metal patterning on a dielectric substrate, but the method for characterization of artificial impedance surfaces is not limited to this embodiment. With the relationship between metal patterning and tensor impedance determined, one may now implement a tensor impedance function giving the desired radiation properties.

For artificial impedance surfaces as characterized by a scalar impedance, the scalar relationship between surface current and tangential electric field for bound waves is characterized by a single real parameter: for transverse magnetic (TM) surface waves, the scalar impedance is given by $Z_{TM}=-iX$, where i is the imaginary constant and X>0 (here we use normalized units, so that the impedance is normalized to the free space value of 377 ohms). Similarly, for transverse electric (TE) surfaces, the scalar impedance is given by $Z_{TE}=+iY$, with Y>0. For a scalar impedance, the bound surface wave has the functional form of $\exp(ik_t \cdot x_t)\exp(-k_z z)$, where $k_t$ and $x_t$ are wavevector and coordinates in the surface, and $k_z$ and z are perpendicular to the surface. Solving Maxwell's equations and the scalar impedance boundary condition gives the scalar TM dispersion relation:

$$k_t = k\sqrt{1+X^2} \text{ and } k_z = kX,$$

where k is the free space wavenumber. Note that the wavenumbers parallel and perpendicular to the surface are related through:

$$k_t^2 - k_z^2 = k^2.$$

The scalar TE bound mode similarly has dispersion relation:

$$k_t = k\sqrt{1+1/Y^2} \text{ and } k_z = k/Y.$$

Scalar impedance values X or Y are then simply determined by measuring or computing the surface wave wavevector $k_t$, and then inverting the dispersion relationships to determine X or Y. When the artificial impedance surface is implemented using an effective medium consisting of periodic unit cells, one may equivalently compute or measure the phase progression across the unit cell to determine the surface wave wavenumber. Note that the scalar impedance has no dependence on surface wave propagation direction.

For artificial impedance surfaces as characterized by an impedance tensor with complex components, the surface current and tangential electric field are related via $$\begin{pmatrix} E_x \\ E_y \end{pmatrix} = \begin{pmatrix} Z_{xx} & Z_{xy} \\ Z_{yx} & Z_{yy} \end{pmatrix} \begin{pmatrix} J_x \\ J_y \end{pmatrix}.$$

For a lossless reciprocal surface, the impedance tensor here must be anti-Hermitian and pure imaginary; the tensor components are three pure imaginary numbers. The impedance tensor must have pure imaginary eigenvalues and orthogonal eigenvectors that specify the principal axes. The pure imaginary eigenvalues correspond to impedances in the principal directions, with a negative imaginary eigenvalue corresponding to a pure TM mode and a positive imaginary eigenvalue corresponding to a pure TE mode. In the following, we will assume that the signs of the tensor impedance eigenvalues are the same so that the surface can be described as TM-like or TE-like. In general, surfaces exist that are TM-like along one principal axis and TE-like along the orthogonal principal axis; they will not be described here.

Although it is assumed that the principal values have the same sign, in all directions except the principal ones the bound surface modes are in general a combination of TE and TM modes, even if the modes along the principal axes are both pure TM or both pure TE. Using the same functional form as for the scalar modes (propagating parallel to the surface and exponentially decaying away from the surface) and allowing for the possibility of combined TE and TM modes, one may solve Maxwell's equations and the tensor impedance boundary condition to find the dispersion relation:

$$\frac{k_z}{k} = \frac{(i(1 - Z_{xy}^2 + Z_{xx}Z_{yy}) \pm \sqrt{-(1 - Z_{xy}^2 + Z_{xx}Z_{yy})^2 + 4(Z_{yy}\cos^2\theta_k - Z_{xy}\sin 2\theta_k + Z_{xx}\sin^2\theta_k)(Z_{xx}\cos^2\theta_k + Z_{xy}\sin 2\theta_k + Z_{yy}\sin^2\theta_k)}}{2(Z_{yy}\cos^2\theta_k - Z_{xy}\sin 2\theta_k + Z_{xx}\sin^2\theta_k)}$$

where the plus sign is used for TM-like surfaces and the minus for TE-like surfaces, and $\theta_k$ gives the direction of surface wave propagation. The wavenumber parallel to the surface may be recovered via $k_t=\sqrt{k^2+k_z^2}$. With the above relation, one can determine the surface wave wavenumbers as a function of propagation direction and tensor impedance components. Notice that in the scalar impedance case the ratio $k_z/k$ gives the scalar impedance (without the imaginary coefficient); one may thus view the above relation as specifying the effective scalar impedance as a function of propagation direction and tensor impedance components. For surface characterization and hologram function implementation, however, one requires the inverse relationship in order to determine the impedance tensor components from propagation angle and wavevector information. To solve for the three unknown impedance components one requires three constraints, which are obtained by measuring or computing the surface wave wavevector at three different propagation angles and then inverting the relationship above to obtain the tensor components $Z_{xx}$, $Z_{xy}$, and $Z_{yy}$. With greater than three data points one may perform a least squares fit to determine the optimal tensor impedance components.

Metal patterns generating tensor impedance with complex components have been investigated, including rectangular, hexagonal, and parallelogram metal patches, as well as squares with slices, squares with vias, and rectangles with two corners removed. All these metal patterns lie over a dielectric substrate, and all have different tensor component ranges. By simulating metal patterns with different geometrical parameters, one can build up a table of impedance tensor components as a function of geometrical parameters. Numerically inverting this data gives a mapping from impedance tensor to geometrical parameters. The tensor hologram function as given by the outer product formulation described above gives the tensor impedance components as a function of position on the impedance surface, which can then be mapped to geometrical parameters of metal patterns as a function of position. This method assumes that the tensor impedances determined from fully periodic structures will not be significantly modified when placed in a lattice with slowly varying structures.

An example of a metal patterning giving a tensor impedance is that of rectangular metal patches within a square lattice. For this case one may use the procedure detailed above to determine the tensor components: for given rectangular dimensions, determine the surface wave wavevector at three different propagation angles and invert the analytical formula above to recover the three tensor components. Alternatively, because of the symmetry of the rectangular patch, the principal axes must be aligned with the x-y axes so that the effective scalar impedances along the x and y directions give the principal values of the impedance tensor. The $Z_{xx}$ impedance varies strongly with the x gap, while the $Z_{yy}$ impedance varies strongly with the y gap. However, the $Z_{xx}$ impedance is not completely independent of the y gap since the capacitance (and hence surface impedance) between metal edges in the x direction is reduced with larger y gaps. To determine the usable range of impedances, one must determine the maximum difference between $Z_{xx}$ and $Z_{yy}$ for a given set of gaps. In general, applications require that the impedance tensor components vary independently; the maximum specified impedance in one component must be implementable at the same time as the minimum specified impedance in the other component. The maximum difference between $Z_{xx}$ and $Z_{yy}$ achievable by the rectangular patch structure thus limits the values of impedance available to the tensor hologram function. For a rectangular patch in square unit cell structure with lattice constant of 2 mm, with gaps ranging from 0.2 mm to 1.0 mm on a 1.27 mm deep dielectric with dielectric constant 10.2 at 10 GHz, the usable range of impedance is 192.9 to 417.3 jΩ.

An artificial impedance surface that scatters a vertically polarized one-dimensional TM surface wave into a horizontally polarized beam may be realized using the rectangular patch structure described above. The polarization switching tensor impedance scattering the vertically polarized surface wave into the horizontally polarized beam is given (in SI units) by:

$$Z(x) = j\begin{pmatrix} X & M\cos(2\pi/ax) \\ M\cos(2\pi/ax) & X \end{pmatrix},$$

where x is the direction of propagation of the surface wave and a the periodicity of impedance modulation. The periodicity is related to the beam angle $\theta_L$ via:

$$a = \frac{2\pi}{k\left(\sqrt{1 + (X/Z_0)^2} - \sin\theta_L\right)},$$

where k is the free space wavenumber and $Z_0$ the free space impedance. X and M specify the numerical values of the average and modulation of the surface impedance; for the rectangular structure above the values are X=305.1 and M=112.2. Note that the above tensor is not aligned along the x-y axes, as is required if the rectangular patch structure is to be used. However, the above tensor has principal axes always aligned along 45° and 135°, with principal values $Z_1=j(X+M \cos [2\pi/a\ x])$ and $Z_2=j(X-M \cos [2\pi/a\ x])$. Thus, one may rotate the axes of the unit cells 45° with respect to the direction of propagation of the surface wave to implement the desired tensor impedance function with the rectangles in a square lattice.

EXAMPLE EMBODIMENTS

According to a first aspect of the disclosure, a method for creating an artificial impedance surface is disclosed, comprising: electing a desired far-field pattern for a surface; determining design impedance values as a function of location on the surface that would produce the desired far-field pattern; selecting a patterning shape for the surface, the patterning shape having at least one geometric characteristic; and measuring sample tensor impedance component values for a plurality of test surfaces that have test patterning shapes that have varied measurements for the at least one geometric characteristic; for each location on the surface, (i) determining what values of the at least one geometric characteristic would give impedance values that most closely approximate the design impedance values for that location and (ii) patterning the surface to include a unit cell with the patterning shape modified to have said at least one geometric characteristic would give impedance values that most closely approximate the design impedance values for that location.

According to a second aspect of the disclosure, a method for creating an artificial impedance surface is disclosed, comprising: selecting a lattice design for the artificial impedance surface having a plurality of unit frames; selecting, for the plurality unit frames, a surface patterning shape having at least one geometric characteristic that can be varied among the unit frames; selecting a desired far-field pattern for the artificial impedance surface; determining design impedance component values at each unit frame of the artificial impedance surface that would give the artificial impedance surface the desired far-field pattern; determining each of the at least one geometric characteristic as a function of sample impedance component values; for a given unit frame on the artificial impedance surface, use the at least one geometric characteristic as a function of the sample impedance component values and the design impedance component values to determine the values of the at least one geometric characteristic for said given unit frame that approximates the design impedance component values for said given unit frame; and patterning the artificial impedance surface with the surface patterning shape, varying the at least one geometric characteristic for each unit frame of the artificial impedance surface to substantially provide the desired far-field pattern.

According to a third aspect of the disclosure, the method of the second aspect of the disclosure is disclosed wherein at least one of the design impedance component values is a complex number.

According to a fourth aspect of the disclosure, the method of the second aspect of the disclosure is disclosed wherein determining design impedance component values at each unit frame of the artificial impedance surface that would give the artificial impedance surface the desired far-field pattern includes a holographic analysis of the desired far-field pattern.

According to a fifth aspect of the disclosure, the method of the second aspect of the disclosure is disclosed wherein determining each of the at least one geometric characteristic as a function of the impedance component values includes building at least one table of impedance component values versus the at least one geometric characteristic variable and inverting the at least one table to determine each of the at least one geometric characteristic as a function of the impedance component values.

According to a sixth aspect of the disclosure, the method of the fifth aspect of the disclosure is disclosed, wherein the building at least one table of impedance component values versus the at least one geometric characteristic variable includes: (a) selecting values for at least one geometric characteristic; (b) providing a sample artificial impedance surface having the patterning shape; (c) providing a surface wave over the sample artificial impedance surface in a selected direction; (d) measuring an effective scalar impedance along said selected direction; (e) repeating steps (c) and (d) in at least two other directions; (f) solving for tensor impedance components as a function of the effective scalar impedances; (g) adding the tensor impedance components as a function of the effective scalar impedances to the at least one table of impedance component values versus the at least one geometric characteristic variable; and (h) altering at least one of the values of the at least one geometric characteristic of the patterning shape and repeating steps (b)-(g) a plurality of times.

According to a seventh aspect of the disclosure, the method of the second aspect of the disclosure is disclosed, wherein determining each of the at least one geometric characteristic as a function of sample impedance component values includes: providing a plurality of test artificial impedance surfaces having the surface patterning shape patterned onto it in a repeating lattice of units, wherein the surface patterning shape patterned onto each of the plurality of test artificial impedance surfaces has uniform geometric characteristics for all units in the repeating lattice and said uniform geometric characteristics differ in at least one respect from the geometric characteristics of the surface patterning shape of any other test artificial impedance surface of the plurality of test artificial impedance surfaces; providing at least three surface waves along at least three different directions over each of the plurality of test artificial impedance surfaces; measuring the effective scalar impedances of each test artificial impedance surface in each direction of the at least three different directions; solving for test impedance components as a function of the effective scalar impedances; numerically inverting the test impedance components as a function of the effective scalar impedances to determine each of the at least one geometric characteristic as a function of sample impedance component values.

According to a eighth aspect of the disclosure, the method of the second aspect of the disclosure is disclosed, wherein the sample artificial impedance surface includes: a dielectric layer having generally opposed first and second surfaces; a conductive layer disposed on the first surface; and a plurality of conductive structures disposed on the second surface to provide an impedance profile along the second surface, wherein each conductive structure includes the surface patterning shape.

According to an ninth aspect of the disclosure, the method of the second aspect of the disclosure is disclosed, wherein the surface patterning shape includes a square.

According to a tenth aspect of the disclosure, the method of the fifth aspect of the disclosure is disclosed, wherein the surface patterning shape includes a square with a slice.

According to a eleventh aspect of the disclosure, the method of the fifth aspect of the disclosure is disclosed, wherein the surface patterning shape includes a rectangle with one or more corners missing.

According to an twelfth aspect of the disclosure, the method of the seventh aspect of the disclosure is disclosed, wherein the determining each of the at least one geometric characteristic as a function of sample impedance component values is performed by computer simulation.

According to a thirteenth aspect of the disclosure, an artificial impedance surface is disclosed, comprising: a dielectric base and a plurality of conductive structures on the dielectric base; wherein the plurality of conductive structures are patterned such that the artificial impedance surface is characterized by an impedance tensor with complex components, said complex components configured to provide the artificial impedance surface with a predetermined far field radiation pattern having a predetermined polarization.

DETAILED DESCRIPTION OF THE FIGURES

While the tensor below is typically given in terms of three tensor impedance components (Zxx, Zxy, and Zyy), it is understood that the tensor may also be given in terms of two tensor principle values (Z1 and Z2) and an angle of rotation (Θ).

Figure 1A:
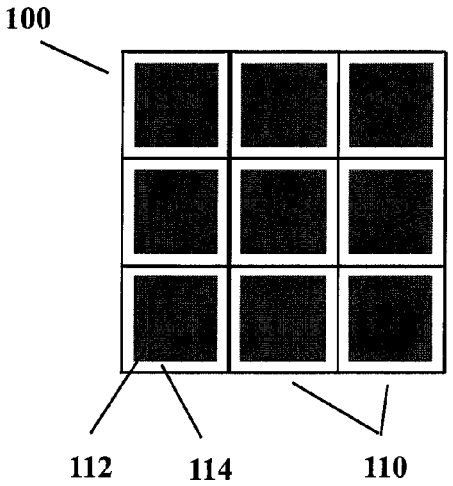
FIG. 1*a* depicts an artificial impedance surface design with square conductive structures.
Figure 1B:
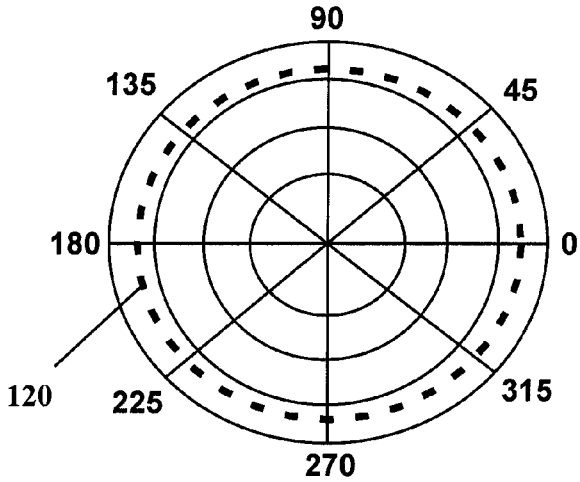
FIG. 1*b* illustrates the effective scalar impedance as a function of propagation direction for the artificial impedance surface of FIG. 1*a*.

FIG. 1*a* shows a basic example of an artificial impedance surface design. The artificial impedance surface 100 can be composed of conductive structures 112 on a dielectric substrate 114, repeated as square unit cells 110. In this example, the structures 112 are squares. FIG. 1*b* illustrates the effective scalar impedance ($Z_0$ $k_z/k$) 120 as a function of propagation direction (in degrees) for an artificial impedance surface constructed out of square unit cells with square conductive patches over a dielectric substrate at 10 GHz, such as the one seen in FIG. 1*a*. As can be seen, the effective surface impedance is independent of propagation direction and is well approximated by a single scalar impedance. The side of the dielectric opposite the side with the conductive structures is covered by a conductive layer (not shown).

Figure 2A:
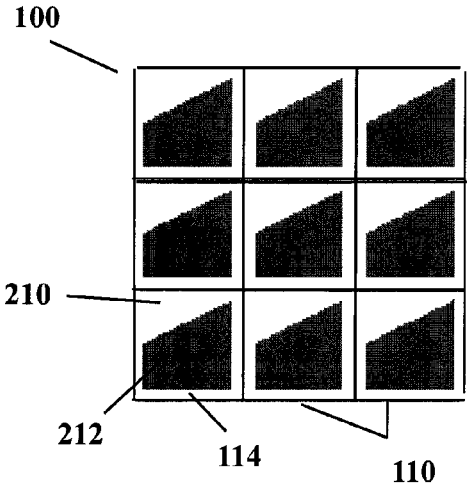
FIG. 2*a* depicts an artificial impedance surface design with trapezoidal conductive structures.
Figure 2B:
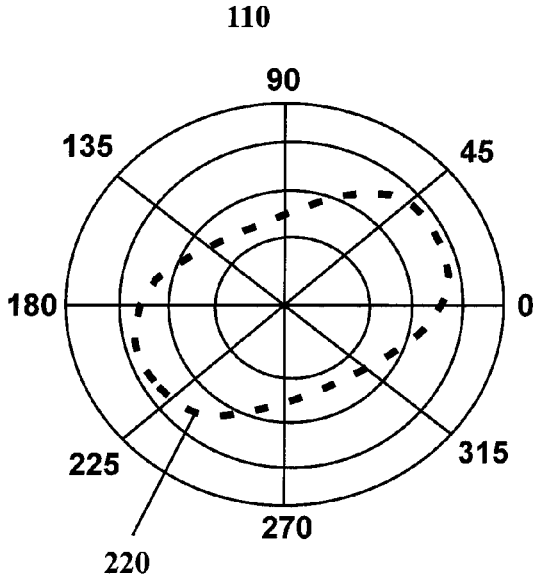
FIG. 2*b* illustrates the effective scalar impedance as a function of propagation direction for the artificial impedance surface of FIG. 2*a*.

FIG. 2*a* shows a modification of the artificial impedance surface design shown in FIG. 1*a*. It is identical to the square structure design except that a portion 210 of the structure has been removed or left out, leaving a trapezoidal conductive structure 212. FIG. 2*b* illustrates the effective scalar impedance 220 as a function of propagation direction for an artificial impedance surface 100 constructed out of square unit cells with trapezoidal conductive structures 212 over a dielectric substrate 114 at 10 GHz, such as the one seen in FIG. 2*a*. Here, the effective scalar impedance clearly depends on propagation direction; additionally, data points derived by measurement (not shown) are well-described by the effective scalar impedance given by the relation above. For the measured data the best fit impedance tensor has components in SI units of ($Z_{xx}$=+222.7 jΩ, $Z_{xy}$=+31.2 jΩ, $Z_{yy}$=+179.1 jΩ) while the scaled best fit computer simulated impedance tensor has components of ($Z_{xx}$=+220.5 jΩ, $Z_{xy}$=+29.0 jΩ, $Z_{yy}$=+188.5 jΩ), showing that the surface is well described by the analytical relationships derived above, and showing good agreement between measurement and computational modeling.

Figure 3A:
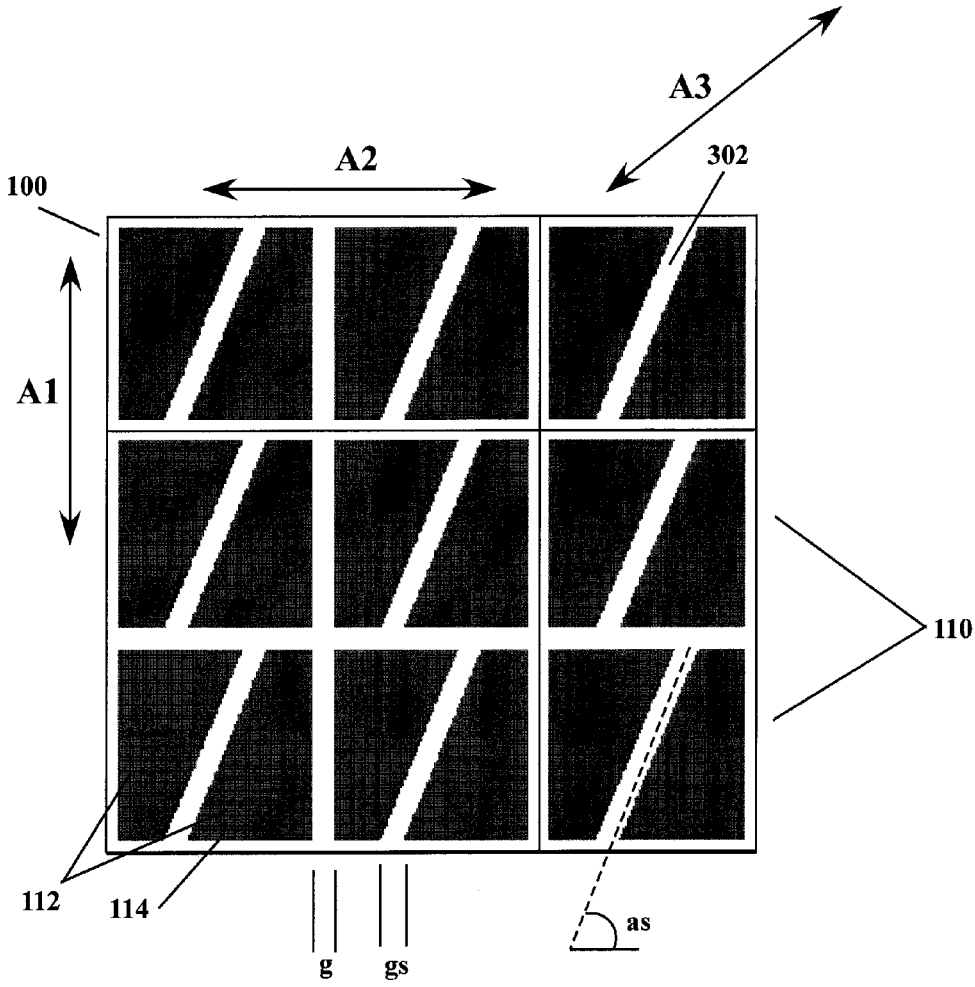
FIG. 3*a* depicts an artificial impedance surface design with square conductive structures with a slice in each structure.

FIG. 3*a* depicts example numerical data of the square 112 with slice 302 geometry. The data is provided as an explicit example of the impedance tensor-geometrical parameter mapping procedure using the analytical formulation above. Here three geometrical parameters control the metal patterning: gap size between squares g, gap size of the slice gs, and angle of the slice as.

Computer simulation or experimentation can be used to determine the surface wave wavevectors for a range of gaps between squares g, gaps of the slice gs, angles of the slice as, and surface wave propagation directions (see A1, A2, and A3 of FIG. 4) for a given surface wave W. The impedance tensor component (Zyy, Zxy, Zxx) can then be determined for that geometry. A typically simple computation uses the three wave propagation directions A1, A2, and A3 that, for this example, are along one principle axis A1 of the unit squares 110, along the other principle axis A2 of the unit squares 110, and along a bisector of two axes A3. However, any three directions could be used so long as the result is three wavevectors in terms of three unknown impedance tensor components (i.e. f1 (Zxx, Zxy, Zyy), f2(Zxx, Zxy, Zyy), and f3(Zxx, Zxy, Zyy)) and, as shown below, there are geometries that would be simplified by other axes orientation. The three wavevectors can then be solved for the three tensor components (Zxx, Zxy, and Zyy). These components can then be placed in a table entry related to the geometric variables (in this case, g, gs, and as).

Figure 3B:
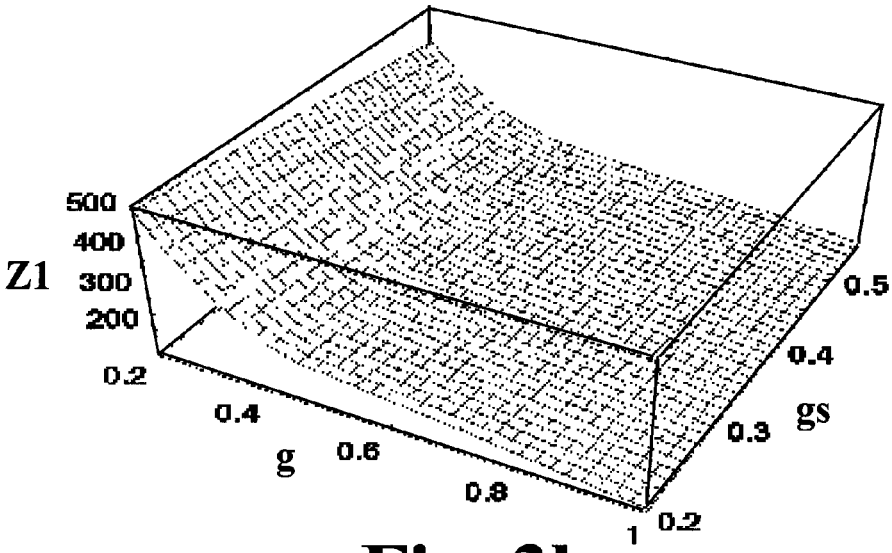
FIG. 3*b* depicts a table of tensor impedance along the slice direction vs. design geometry values for the artificial impedance surface of FIG. 3*a*.
Figure 3C:
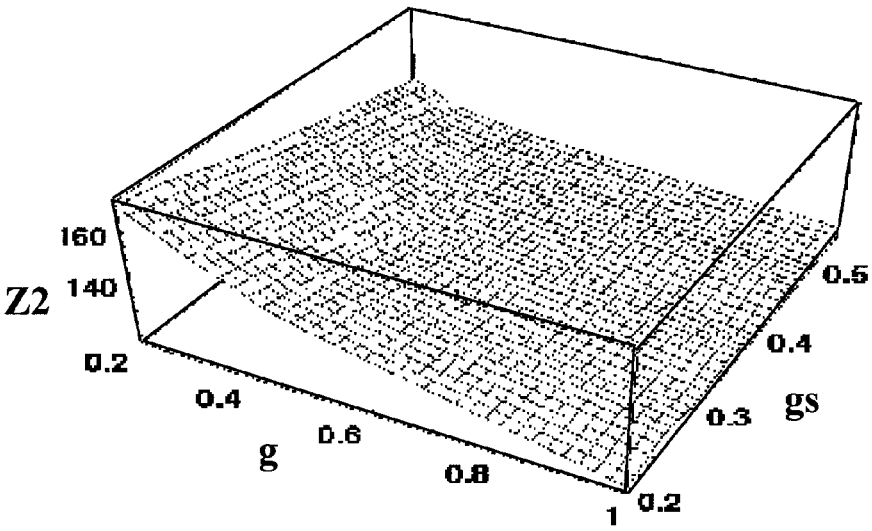
FIG. 3*c* depicts a table of tensor impedance perpendicular to the slice direction vs. design geometry values for the artificial impedance surface of FIG. 3*a*.

Both FIGS. 3*b* and 3*c* show principal values of the impedance tensor (Z1 or Z2) as a function of the gap g between squares and the gap gs in the slice 302. In this example, Z1 and Z2 are given in jΩ and g and gs are given in mm units. If the orientation of one the principal axes (A1 or A2) follows the slice angle as rather than an axis of the unit square 110, the impedance to geometrical parameter mapping becomes two-to-two rather than three-to-three, i.e., the inversion of the principal axis angle to geometrical parameter (slice angle as) is immediate. FIG. 3*b* depicts a graph of impedance major axis component along the slice direction Z1 versus the gap between squares g and the gap size of the slice gs for the direction of the major axis along the slice angle as. FIG. 3*c* depicts a graph of tensor impedance minor axis component perpendicular to the slice direction Z2 versus the gap between squares g and the gap size of the slice gs for the direction of the minor axis perpendicular to the major axis. The geometry of a square with a slice places constraints on the values of achievable impedances for the slice geometry; e.g., one cannot construct a slice geometry that has the same impedance along both principal axes. However, applications do not generally require arbitrary relationships between the principal impedance values. One must determine the metal patterning that will achieve the impedance values required by the tensor hologram function for each specific application.

Figure 4:
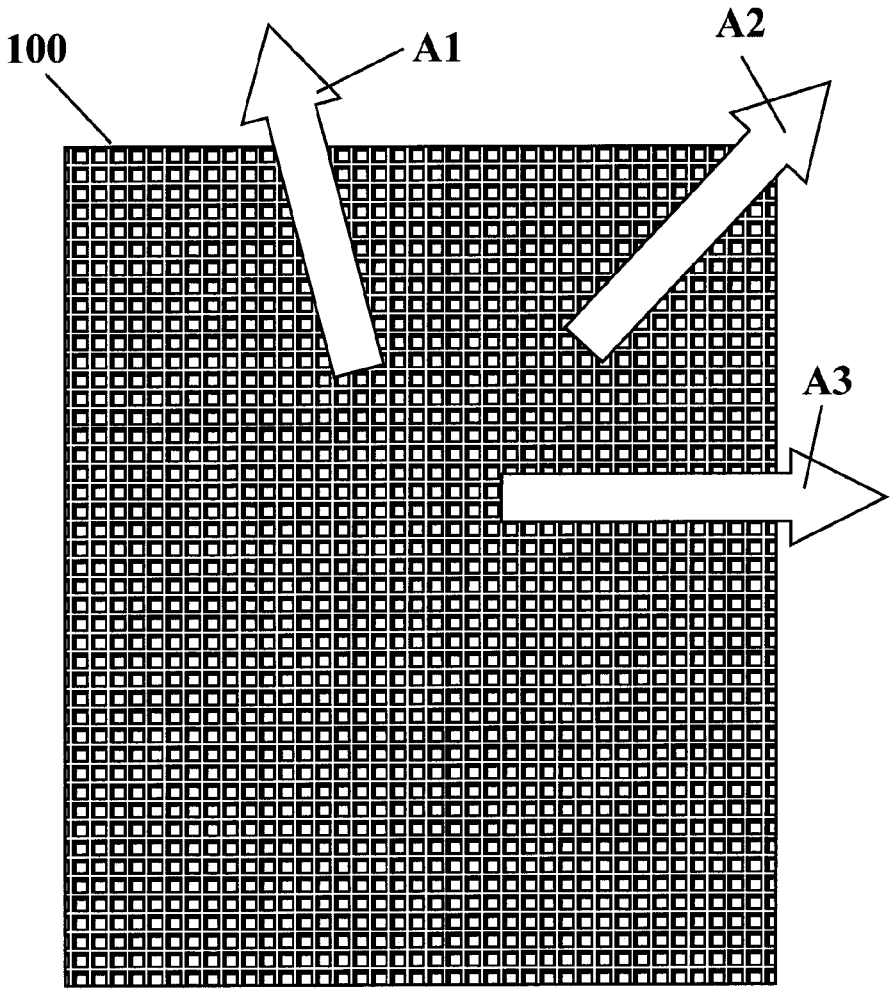
FIG. 4 depicts an example of wavevectors for a given surface wave along an artificial impedance surface.

FIG. 4 depicts three example wavevector directions A1, A2, and A3 over an artificial impedance surface 100. The wavevectors are typically individually measured by exciting a surface wave in the direction of the wavevector to be measured. The wavevectors can be measured by determining the wave phase progression as a function of distance in the direction of wave propagation; alternatively, the wavevectors may be calculated via simulation by determining the surface wave phase progression across a unit cell. More than three wavevectors can be used, but at least three are needed to calculate the three impedance tensor values Zxx, Zxy, and Zyy.

Figure 5:
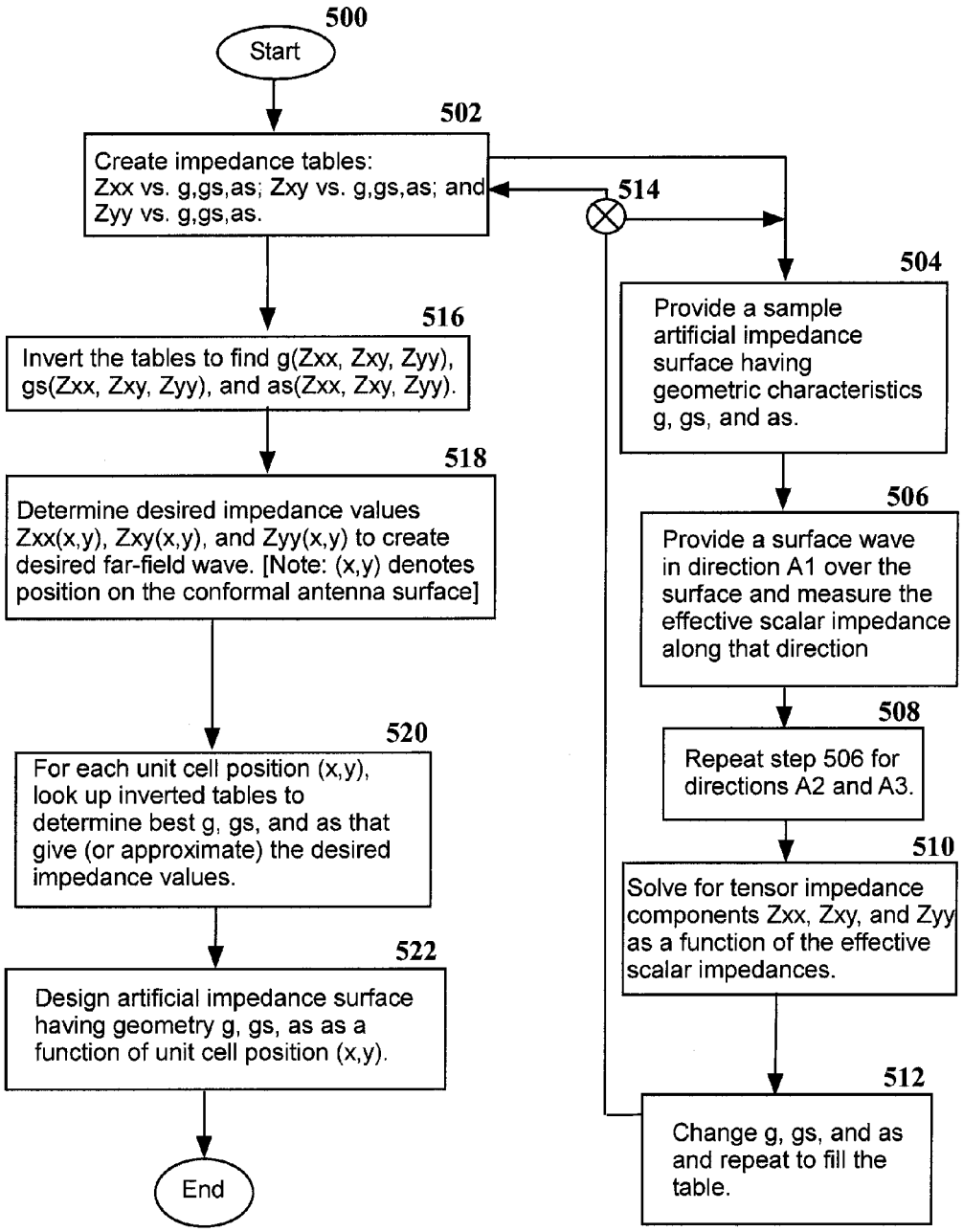
FIG. 5 depicts an example flowchart for designing an artificial impedance surface with desired radiation properties (e.g. tensor impedance values).

FIG. 5 shows an example of a procedure to design an artificial impedance surface with squares-with-slice geometry (as shown in FIG. 3*a*). In this example, the patterning shape of the artificial impedance surface is a square with a slice cut out of it, with the gap between the squares, the gap of the slice, and the angle of the slice varied to control the impedance and polarization characteristics of the surface. However, any repeated shape can be used and any set of geometric characteristics can be varied. For another example, the shape could be a repeated oval and the characteristics could be the size of the major axis, the size of the minor axis, and/or the angle of the major axis. (Any number of characteristics may be used . . . it does not have to be three). The process begins 500 using either computer simulation or laboratory/field experimentation of a sample surface wave propagating over a set of sample artificial impedance surfaces having the patterned shape. A set of tables are created 502 to find functions of Zxx, Zxy, and Zyy for various values of g (gap between squares), gs (gap size of the slice), and as (angle of the slice). This can be done by establishing a sample artificial impedance surface having the geometric characteristics g, gs, and as 504. Then a sample surface wave can be provided (or simulated) in a direction (A1) over the surface and the effective scalar impedance for that direction can be measured (or calculated) 506. Repeating this step for two other directions (A2 and A3) provides two more effective scalar impedances 508. From these three effective scalar impedances, one can solve for the tensor impedance components (Zxx, Zxy, and Zyy) as a function of the effective scalar impedances 510. Those steps 504-510 can be repeated for different values of g, gs, and as to build a full table of the tensor impedance components (Zxx, Zxy, Zyy) vs. the geometric properties (g, gs, as) 512. This is repeated until a satisfactory table has been built, upon discretion of the designer 514. Then the tables can inverted to depict g, gs, and as values in terms of the tensor impedance components 516. Then, given a desired far-field wave pattern in terms of Zxx, Zxy, and Zyy 518, values of g(x,y), gs(x,y), and as(x,y) can be determined that will substantially produce those tensor impedance values 520. Knowing the geometric properties required at each unit square on the surface (in this case, g, gs, and as at position (x,y)), an artificial impedance surface can be designed to substantially produce the desired far-field pattern 522.

Figure 6:
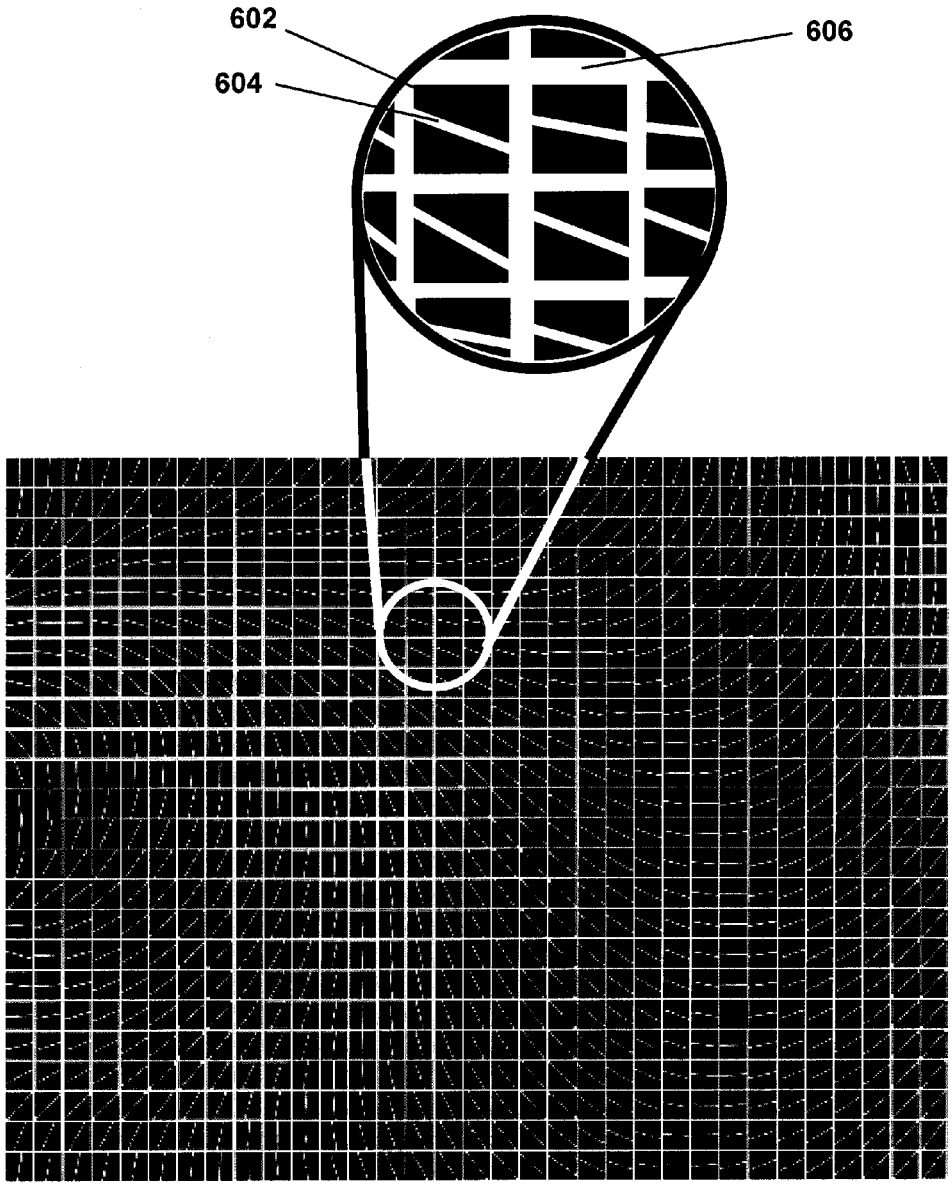
FIG. 6 depicts an example of an artificial impedance surface (as characterized by an impedance tensor with complex components) designed by a disclosed method.

FIG. 6 depicts an example of a portion of a designed artificial impedance surface as characterized by an impedance tensor having complex components. An exploded view is provided to aid clarity. The lattice is composed of conductive unit squares 602 separated by a gap 606, each square having a slice 604 through them. Those geometric qualities define the patterning shape of the example. The geometric attributes that are varied among the unit squares 602 are the angle of the slice 604 and the gap 606 between the unit squares 602. The variation of the angle of the slice 604 at different points on the surface control the shape and polarization of the far field.

Figure 7:
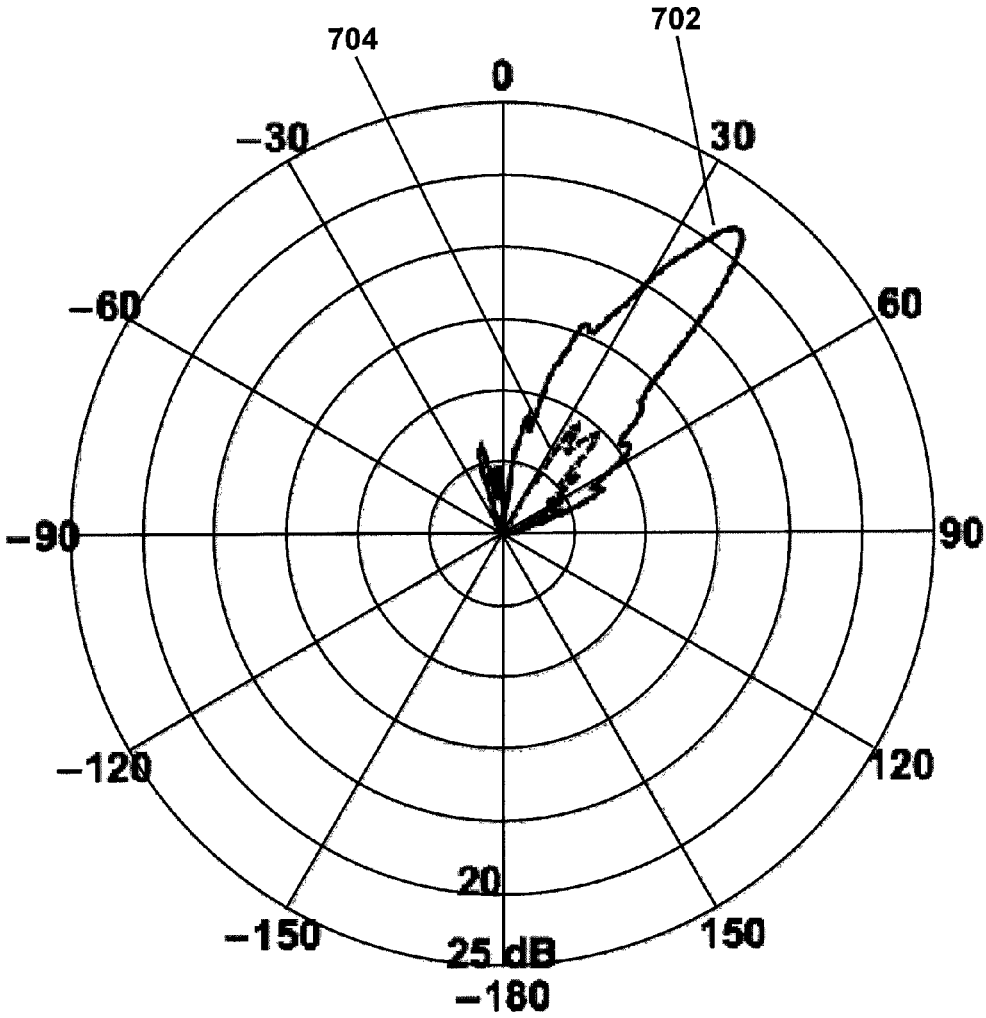
FIG. 7 depicts an example of measured far field radiation from a surface with sliced square patterning.

FIG. 7 depicts an example of a measured far field radiation pattern created by an artificial impedance surface depicted, in part, in FIG. 6 (a lattice of squares with slices through them). The solid line 702 is the left-hand circular polarization (LHCP) and the dashed line 704 is the cross polarization (right-hand circular polarization, or RHCP). The surface is designed to emit left-hand circular polarization at 45 degrees from vertical when excited by a vertically polarized surface wave. The LHCP beam has a measured gain of 21.8 dB at 38 degrees, with the cross polarization (RHCP) measurement down by 19.6 dB In the above description, numerous specific details are set forth to clearly describe various specific embodiments disclosed herein. One skilled in the art, however, will understand that the presently claimed invention may be practiced without all of the specific details discussed. In other instances, well known features have not been described so as not to obscure the invention.

What is claimed is:

1. A method for creating an artificial impedance surface characterized by an impedance tensor, comprising:

selecting a desired far-field pattern for a surface;

determining design impedance values as a function of location on the surface that would produce the desired far-field pattern;

selecting a patterning shape for the surface, the patterning shape having at least one geometric characteristic; and measuring sample tensor impedance component values for a plurality of test surfaces that have test patterning shapes that have varied measurements for the at least one geometric characteristic;

for each location on the surface, (i) determining what values of the at least one geometric characteristic would give impedance values that most closely approximate the design impedance values for that location and (ii) patterning the surface to include a unit cell with the patterning shape modified to have said at least one geometric characteristic would give impedance values that most closely approximate the design impedance values for that location.

2. A method for creating an artificial impedance surface characterized by an impedance tensor, comprising:

selecting a lattice design for the artificial impedance surface having a plurality of unit frames;

selecting, for the plurality unit frames, a surface patterning shape having at least one geometric characteristic that can be varied among the unit frames; selecting a desired far-field pattern for the artificial impedance surface; determining design impedance component values at each unit frame of the artificial impedance surface that would give the artificial impedance surface the desired far-field pattern;

determining each of the at least one geometric characteristic as a function of sample impedance component values;

for a given unit frame on the artificial impedance surface, use the at least one geometric characteristic as a function of the sample impedance component values and the design impedance component values to determine the values of the at least one geometric characteristic for said given unit frame that approximates the design impedance component values for said given unit frame; and patterning the artificial impedance surface with the surface patterning shape, varying the at least one geometric characteristic for each unit frame of the artificial impedance surface to substantially provide the desired far-field pattern.

3. The method of claim 2, wherein at least one of the design impedance component values is a complex number.

4. The method of claim 2, wherein determining design impedance component values at each unit frame of the artificial impedance surface that would give the artificial impedance surface the desired far-field pattern includes a holographic analysis of the desired far-field pattern.

5. The method of claim 2, wherein determining each of the at least one geometric characteristic as a function of the impedance component values includes building at least one table of impedance component values versus the at least one geometric characteristic variable and inverting the at least one table to determine each of the at least one geometric characteristic as a function of the impedance component values.

6. The method of claim 5, wherein the building at least one table of impedance component values versus the at least one geometric characteristic variable includes:

(a) selecting values for at least one geometric characteristic;

(b) providing a sample artificial impedance surface having the patterning shape;

(c) providing a surface wave over the sample artificial impedance surface in a selected direction;

(d) measuring an effective scalar impedance along said selected direction;

(e) repeating steps (c) and (d) in at least two other directions;

(f) solving for tensor impedance components as a function of the effective scalar impedances;

(g) adding the tensor impedance components as a function of the effective scalar impedances to the at least one table of impedance component values versus the at least one geometric characteristic variable; and (h) altering at least one of the values of the at least one geometric characteristic of the patterning shape and repeating steps (b)-(g) a plurality of times.

7. The method of claim 5, wherein the surface patterning shape includes a square with a slice.

8. The method of claim 5, wherein the surface patterning shape includes a rectangle with one or more corners missing.

9. The method of claim 2, wherein determining each of the at least one geometric characteristic as a function of sample impedance component values includes: providing a plurality of test artificial impedance surfaces having the surface patterning shape patterned onto it in a repeating lattice of units, wherein the surface patterning shape patterned onto each of the plurality of test artificial impedance surfaces has uniform geometric characteristics for all units in the repeating lattice and said uniform geometric characteristics differ in at least one respect from the geometric characteristics of the surface patterning shape of any other test artificial impedance surface of the plurality of test artificial impedance surfaces;

providing at least three surface waves along at least three different directions over each of the plurality of test artificial impedance surfaces;

measuring the effective scalar impedances of each test artificial impedance surface in each direction of the at least three different directions;

solving for test impedance components as a function of the effective scalar impedances; numerically inverting the test impedance components as a function of the effective scalar impedances to determine each of the at least one geometric characteristic as a function of sample impedance component values.

10. The method of claim 9, wherein the determining each of the at least one geometric characteristic as a function of sample impedance component values is performed by computer simulation.

11. The method of claim 2, wherein the sample artificial impedance surface includes:

a dielectric layer having generally opposed first and second surfaces;

a conductive layer disposed on the first surface; and a plurality of conductive structures disposed on the second surface to provide an impedance profile along the second surface, wherein each conductive structure includes the surface patterning shape.

12. The method of claim 2, wherein the surface patterning shape includes a square.

13. An artificial impedance surface comprising:

a dielectric base and a plurality of conductive structures on the dielectric base;

wherein the plurality of conductive structures are geometrically and holographically patterned such that the artificial impedance surface is characterized by an impedance tensor with complex components.

14. The artificial impedance surface of claim 13, wherein said complex components are configured to provide the artificial impedance surface with a predetermined far field radiation pattern having a predetermined polarization.

15. The artificial impedance surface of claim 13, wherein the conductive structures are arranged to provide a propagation constant of the artificial impedance surface that varies as a function of both direction along and position on the artificial impedance surface.

* * * * *